US011318779B2

(12) United States Patent
Li

(10) Patent No.: US 11,318,779 B2
(45) Date of Patent: May 3, 2022

(54) PENCIL SHARPENER HAVING FLEXIBLE STORAGE COVER

(71) Applicant: SHANGHAI LEES MANUFACTURING CO., LTD., Shanghai (CN)

(72) Inventor: Lei Xin Li, Shanghai (CN)

(73) Assignee: SHANGHAI LEES MANUFACTURING CO., LTD., Shanghai (CN)

( * ) Notice: Subject to any disclaimer, the term of this patent is extended or adjusted under 35 U.S.C. 154(b) by 0 days.

(21) Appl. No.: 17/257,576

(22) PCT Filed: Aug. 16, 2018

(86) PCT No.: PCT/CN2018/100895
§ 371 (c)(1),
(2) Date: Jan. 3, 2021

(87) PCT Pub. No.: WO2020/006819
PCT Pub. Date: Jan. 9, 2020

(65) Prior Publication Data

US 2021/0268830 A1 Sep. 2, 2021

(30) Foreign Application Priority Data

Jul. 5, 2018 (CN) ..... 201810728720.8

(51) Int. Cl.
*B43L 23/08* (2006.01)

(52) U.S. Cl.
CPC ..... *B43L 23/08* (2013.01); *B43L 23/085* (2013.01)

(58) Field of Classification Search
CPC ..... B43L 23/08; B43L 23/085
USPC ..... 30/453, 454
See application file for complete search history.

(56) References Cited

U.S. PATENT DOCUMENTS 6,381,856 B2 * 5/2002 Luttgens ..... B43L 23/00 144/28.11
9,505,551 B2 * 11/2016 Elliot ..... B65F 1/0006
2001/0016989 A1 8/2001 Luttgens
2014/0219584 A1 * 8/2014 Hutchins ..... B65F 1/002 383/33

(Continued)

FOREIGN PATENT DOCUMENTS

CN 202480715 U 10/2012
CN 204432187 U 7/2015

(Continued)

*Primary Examiner* — Omar Flores Sanchez
(74) *Attorney, Agent, or Firm* — Mark M. Friedman

(57) ABSTRACT

A pencil sharpener having a flexible storage cover, comprising a pencil sharpener main body portion (2). The main body portion (2) comprises a base (22) and a blade (26) accommodated in the base (22). The blade (26) is provided with an insertion hole for insertion of a pencil. The base (22) is provided with a base portion (23). The top of the base portion (23) is provided with at least one hole (2312) corresponding to the insertion hole. The pencil sharpener further comprises a flexible storage portion (3) that can be bonded to the base portion (23) or detached from the base portion (23) and used for storing pencil debris. The flexible storage portion (3) comprises a fixing portion (31) and a flexible storage cover (33) bonded to the fixing portion (31). The fixing portion (31) can be bonded to or detached from the base portion (23).

11 Claims, 7 Drawing Sheets

(56) References Cited

U.S. PATENT DOCUMENTS

2015/0266625 A1* 9/2015 Elliot ..... B65F 1/0006
29/452

FOREIGN PATENT DOCUMENTS

| | | | |
|---|---|---|---|
| CN | 206351605 | U | 7/2017 |
| CN | 208558805 | U | 3/2019 |
| DE | 1800222 | A1 | 3/1970 |
| DE | 2734695 | A1 | 2/1979 |

* cited by examiner

PENCIL SHARPENER HAVING FLEXIBLE STORAGE COVER

CROSS REFERENCE TO RELATED APPLICATIONS

This application is a US national phase application based upon an International Application No. PCT/CN2018/100895, filed on Aug. 16, 2018, which claims the priority of Chinese Patent Application No. 201810728720.8, entitled "PENCIL SHARPENER HAVING FLEXIBLE STORAGE COVER", filed on Jul. 5, 2018 in the CNIPA (National Intellectual Property Administration, PRC), the disclosure of which is incorporated herein by reference in its entirety.

BACKGROUND OF THE INVENTION

1. Field of the Invention

The present invention relates to a pencil sharpener, and more particularly to a pencil sharpener having a flexible storage cover.

2. Description of the Prior Art

Pencil sharpeners are commonly used to sharpen wooden pencils and eyebrow pencils. Usually, the pencil can be sharpened when the pencil rotates beside a blade of the pencil sharpener, and pencil shavings directly falls onto a desktop or ground and pollute the environment. Furthermore, a transparent hood is disposed outside the pencil sharpener, and the pencil shavings are reserved in the hood. When the pencil shavings are accumulated to a certain amount, the hood can be detached to pour the pencil shavings into the garbage can. At present, the transparent hoods on the market are all made of hard plastic materials, the hand feeling is hard when the hoods are touched. If the pencil sharpener with the hard hood is stored, a requirement for the shape of the storage space is needed to have enough space matched with the shape of the hood for storage. Therefore, the pencil sharpener with the hard hood on the market at present has the technical problem that the touch hand feeling is hard, and the shape requirement in the storage space is required.

BRIEF SUMMARY OF THE INVENTION

Technical Problem

In order to overcome the defects in the prior art, the present invention discloses a pencil sharpener having a flexible storage cover, which is soft in touch hand feeling and convenient to store.

Technical Solutions

To solve the above technical problem, a technical solution of the present invention is as follows.

A pencil sharpener having a flexible storage cover comprises a main body portion having a base and a blade received in the base for sharpening pencils, an insertion hole is defined in the blade for inserting the pencils, a base portion is disposed on the base, and at least one hole is defined in a top of the base portion corresponding to the insertion hole of the blade, the pencil sharpener further comprises a flexible storage portion for receiving pencil shavings, the flexible storage portion can be assembled to the base portion of the base or disassembled from the base portion of the base.

Further, The flexible storage portion comprises a fixing portion and a flexible storage cover assembled on the fixing portion, and the fixing portion can be assembled to or disassembled from the base portion of base.

Further, a layer of hot melting material is disposed on a hood opening portion of the flexible storage cover, and the flexible storage cover and the fixing portion are fixed together by hot melting technology.

Further, the flexible storage cover and the fixing portion are fixed together by sewing the flexible storage cover.

Further, the fixing portion comprises a first fixing portion and a second fixing portion, an inner diameter of the first fixing portion is slightly larger than that of the second fixing portion, the second fixing portion is wrapped in the hood opening portion of the flexible storage cover, and the first fixing portion clamps and fixes the hood opening portion of the flexible storage cover to an outer portion of the second fixing portion so that the fixing portion and the flexible storage cover can be fixed together.

Further, an internal thread is disposed on the base portion of base, an external thread capable of being in threaded connection with the internal thread of base portion of base is disposed on outer circumference of the fixing portion, the base and the fixing portion are in threaded connection to assemble or disassemble the base and the flexible storage cover.

Further, the base portion of the base and the flexible storage portion are respectively provided with buckle structures so as to fix the base and the flexible storage portion.

Further, a protruding rib is disposed on inner side of the base portion of the base, a groove is defined in the flexible storage portion corresponding to the protruding rib, and the base and the flexible storage portion are fixed together by cooperation of the protruding rib and the groove.

Further, protruding ribs are disposed on inner side of the base portion of the base, grooves are defined in the flexible storage portion corresponding to the protruding ribs, and the base and the flexible storage portion are fixed together by cooperation of the protruding ribs and the grooves.

Further, at least one bendable folding piece is disposed on the lower edge of the circumference of the base portion, a hole is defined in the folding piece, a protrusion is disposed on the fixing portion corresponding to the hole. When the base portion is assembled to the fixing portion, the folding piece is bent to buckle the protrusion into the hole of the folding piece, so that the main body portion and the flexible storage portion are fixed together. When the base portion is disassembled from the fixing portion, the folding piece is pulled away from the protrusion, so that the folding piece is separated from the protrusion to separate the main body portion from the flexible storage portion.

Further, the base comprises a dustproof cover corresponding to the base portion, the dustproof cover and base portion are connected together by a foldable part, the dustproof cover can be opened from base portion when in use, and the dustproof cover can also be covered and buckled and fixed on the base portion after use.

Further, protrusions are disposed on the dustproof cover corresponding to the holes in size and shape of the base portion, when the dustproof cover covers on the base portion, the protrusions protrude and buckle into holes in the top portion of the base portion so as to fix the dustproof cover on the base portion.

Due to the adoption above technical solution, the invention has the following beneficial effects.

The flexible storage cover of the pencil sharpener with the flexible storage cover is soft in hand feeling and can adapt to various stored spaces.

DETAILED DESCRIPTION OF THE PREFERRED EMBODIMENTS

Figure 1:
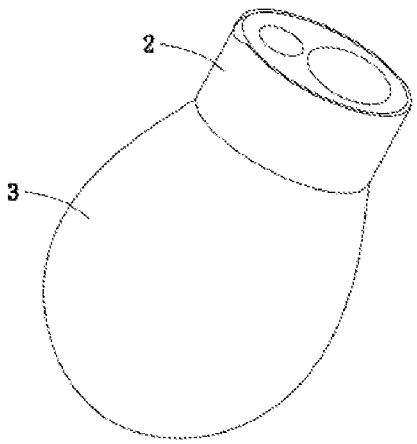
FIG. 1 is a perspective view of first embodiment of a pencil sharpener having flexible storage cover of the present invention.

The invention is further described below in connection with the drawings:

Referring to FIG. 1, it is the first the embodiment of a pencil sharpener having flexible storage cover comprises a main body portion 2 of the pencil sharpener and a flexible storage portion 3.

Figure 2:
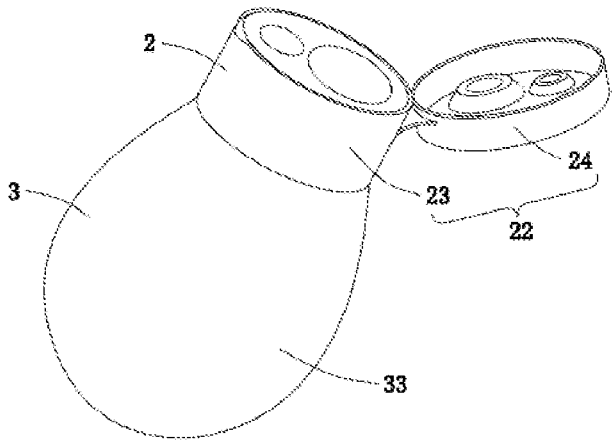
FIG. 2 is a perspective view of second embodiment of the pencil sharpener having flexible storage cover of the present invention.
Figure 3:
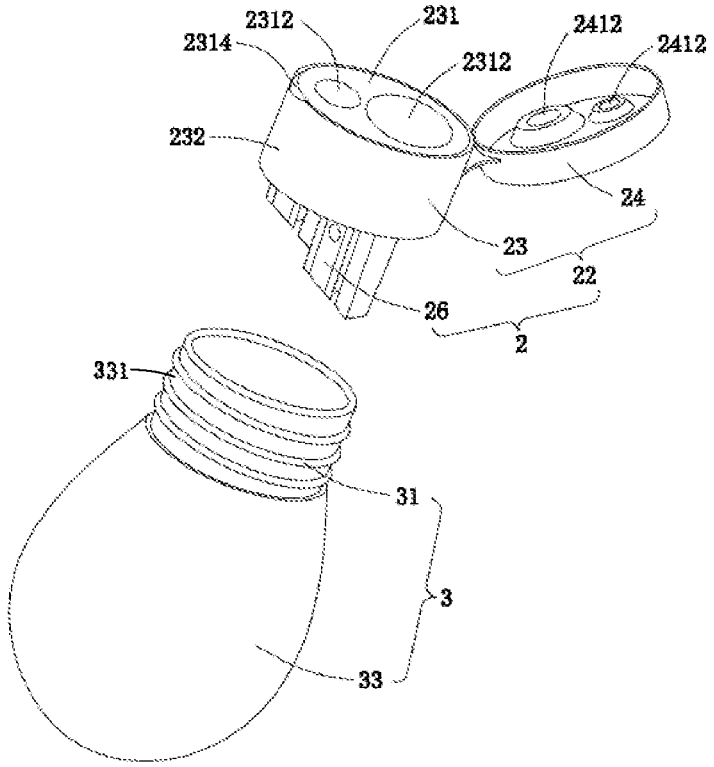
FIG. 3 is an exploded view of FIG. 2.

Referring to FIG. 2 and FIG. 3, it is the second embodiment of the pencil sharpener having flexible storage cover, the pencil sharpener is the same as the first embodiment and comprises the main body portion 2 of the pencil sharpener and the flexible storage portion 3.

The main body portion 2 of the pencil sharpener comprises a base 22 and a blade 26. A difference from the first embodiment, the base 22 comprises besides a base portion 23, also a dustproof cover 24 corresponding to the base portion 23. The dustproof cover 24 and the base portion 23 connects together by a foldable part, and the dustproof cover 24 can be opened from the base portion 23 when in use and can also be buckled and fixed on the base portion 23 after use.

In the present embodiment, the base portion 23 is an annular body having a receiving space. The base portion 23 comprises a top portion 231 and an annular sidewall 232 having a thickness extending downwardly from the top portion 231. At least one hole 2312 is defined in the top portion 231, and a pencil to be sharpened can be just inserted into the hole 2312 in size. In the present embodiment, the base portion 23 is provided with two holes 2312. An edge of the top portion 231 is provided with a notch 2314 adapting to open the dustproof with a finger.

Protrusions 2412 are disposed on the dustproof cover 24 corresponding to the holes 2312 in size and shape, when the dustproof cover 24 covers on the base portion 23, the protrusions 2412 protrude and buckle into the holes 2312 of the top portion 231 so that the dustproof cover 24 can be fixedly covered on the base portion 23. In the present embodiment, an internal thread is disposed on the inner circumference of the sidewall 232.

In the present embodiment, the blade 26 is a conventional two-hole blade for sharpening pencils and is fixed in the receiving space of the base portion 23, and insertion holes for inserting the pencils are defined in the blade 26 and are aligned with the holes 2312 in the base portion 23.

The flexible storage portion 3 comprises a fixing portion 31 and a flexible storage cover 33 assembled on the fixing portion 31. In the present embodiment, the fixing portion 31 is an annular structure, and an external thread is disposed on an outer circumference of the fixing portion 31 for being in threaded connection with the internal thread of the side wall 232 of the base portion 23 of the base 22.

The flexible storage cover 33 is made of a flexible fabric material and used for storing pencil shavings sharpened by the pencil sharpener. In the present embodiment, a layer of hot melting material is disposed on a hood opening portion 331 of the flexible storage cover 33, and the flexible storage cover 33 and the fixing portion 31 are fixed together by hot melting technology.

When a user needs to sharpen the pencil, the dustproof cover 24 is firstly opened, the proper blade is selected to sharpen the pencil according to the size of the outer circumference of the pencil, and the sharpened pencil shavings are dropped into the flexible storage cover 33. When a certain amount of the pencil shavings is accumulated, the flexible storage portion 3 is rotated down from the main body portion 2, and after the pencil shavings are poured out, the flexible storage portion 3 is rotated and fixed back to the main body portion 2. In addition, when the pencil sharpener with the flexible storage cover is placed, the flexible storage cover can flexibly adapt to the shapes of various storage spaces along with the difference of the storage spaces, so that the pencil sharpener with the flexible storage cover is very convenient to store.

Figure 4:
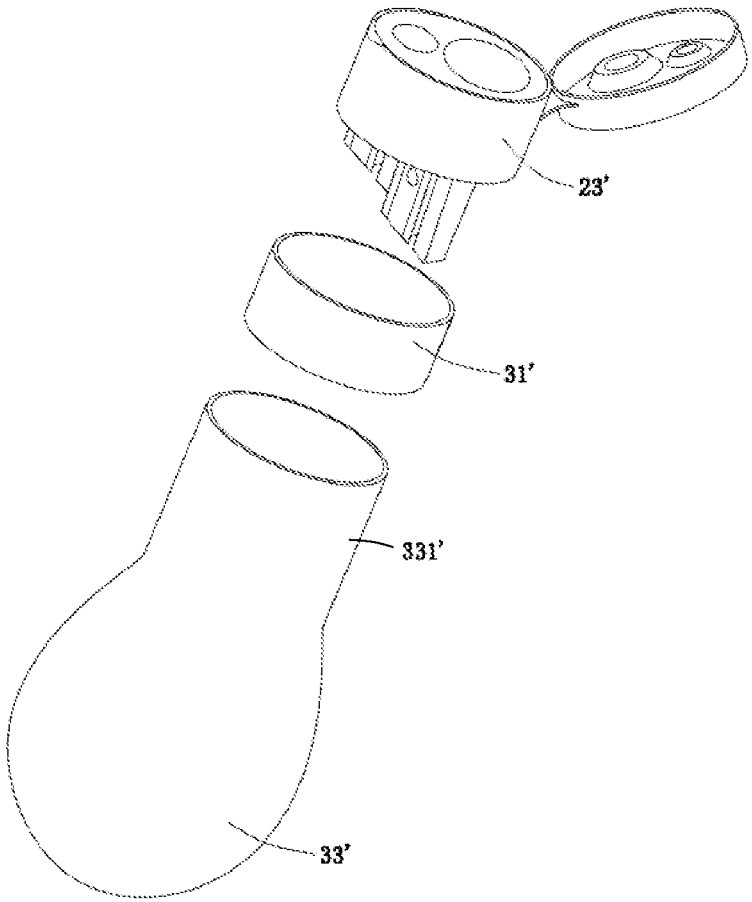
FIG. 4 is a partial exploded view of third embodiment of the pencil sharpener having flexible storage cover of the present invention.
Figure 5:
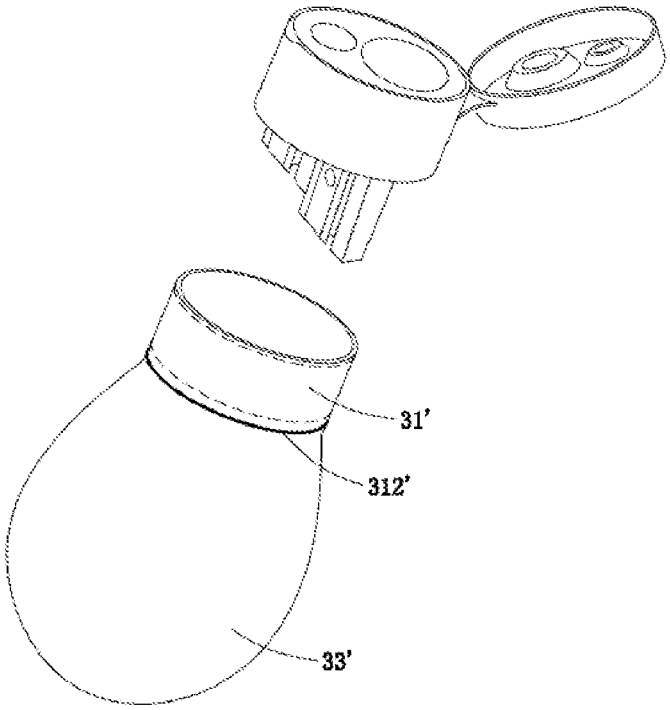
FIG. 5 is a partial perspective view of FIG. 4.

Referring to FIG. 4 and FIG. 5, in the third embodiment, the fixing portion 31' can be sleeved on the hood opening portion 331' of the flexible storage cover 33', the hood opening portion 331' is then turned down to wrap the fixing portion 31' into the hood opening portion 331', and the hood opening portion 331' is sewn by sewing thread 312' to assemble the fixing portion 31' with the flexible storage cover 33'. In the present embodiment, the fixing portion 31' and the base portion 23' are fixed together by an interference fit manner.

Figure 6:
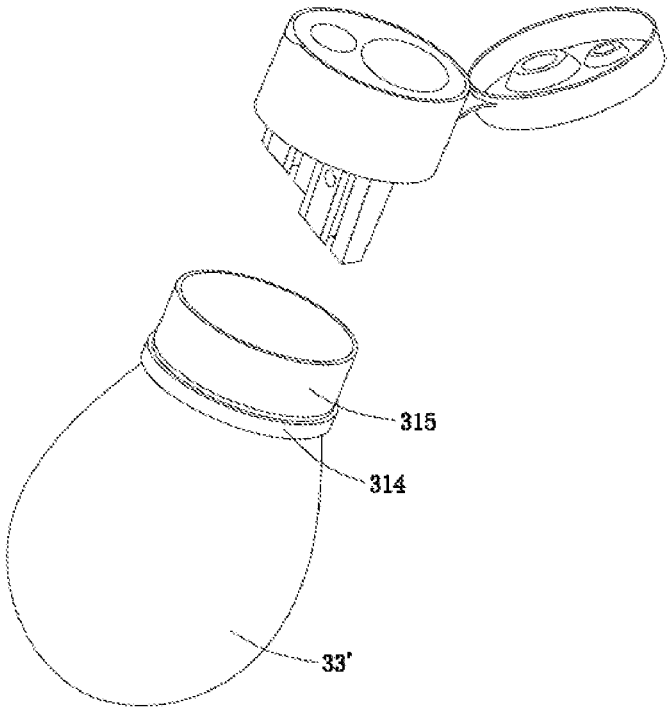
FIG. 6 is a partial exploded view of fourth embodiment of the pencil sharpener having flexible storage cover of the present invention.

In addition, referring to FIG. 6, in the fourth embodiment, the fixing portion can also be in two-piece structures, which are a first fixing portion 314 and a second fixing portion 315, respectively. An inner diameter of the first fixing portion is slightly larger than an inner diameter of the second fixing portion. During assembly, the second fixing portion 315 is wrapped in by the hood opening portion of the flexible storage cover, and the hood opening portion of the flexible storage cover is clamped and fixed outside of the second fixing portion by the first fixing portion 314 so as to fix the fixing portion to the flexible storage cover. Finally, the fixing portion and the base portion are assembled and fixed in an interference fit manner.

Figure 7:
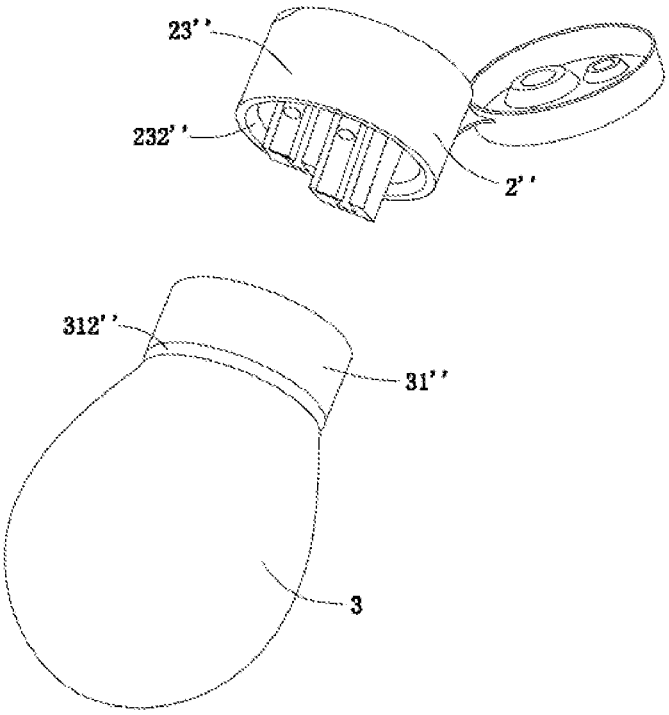
FIG. 7 is a partial exploded view of fifth embodiment of the pencil sharpener having flexible storage cover of the present invention.

Referring to FIG. 7, in the fifth embodiment, an annular protruding rib 232" is disposed inside of a lower edge of the sidewall of the base portion 23", an annular groove 312" is defined in the fixing portion 31" corresponding to the annular protruding rib 232". When the main body portion 2" need to be assembled to the flexible storage portion 3" which is implemented by the protruding rib 232" of the base portion 23" being clipped and embedded into the annular groove 312" of the fixing portion 31".

Figure 8:
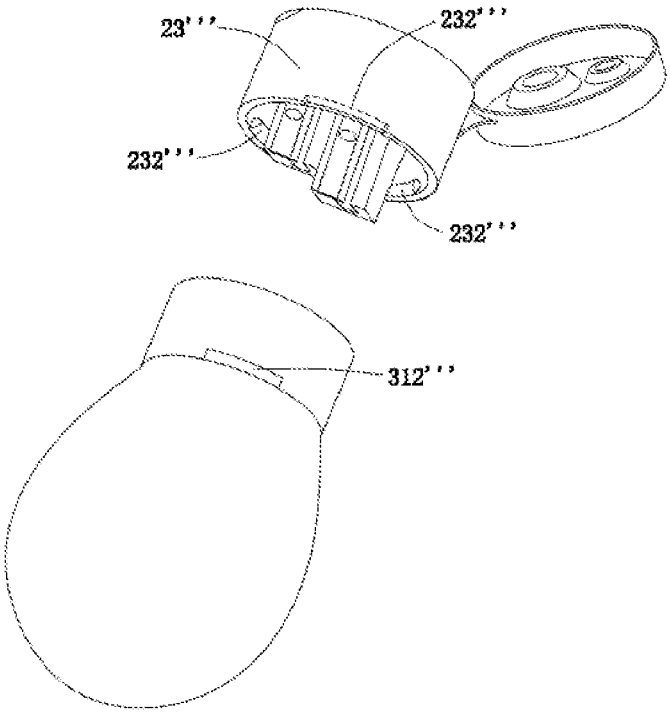
FIG. 8 is a partial exploded view of sixth embodiment of the pencil sharpener having flexible storage cover of the present invention.

Referring to FIG. 8 again, in the sixth embodiment, the rib 232" can be several spaced apart segments of ribs 232", and the annular groove 312" can be a groove 312".

Figure 9:
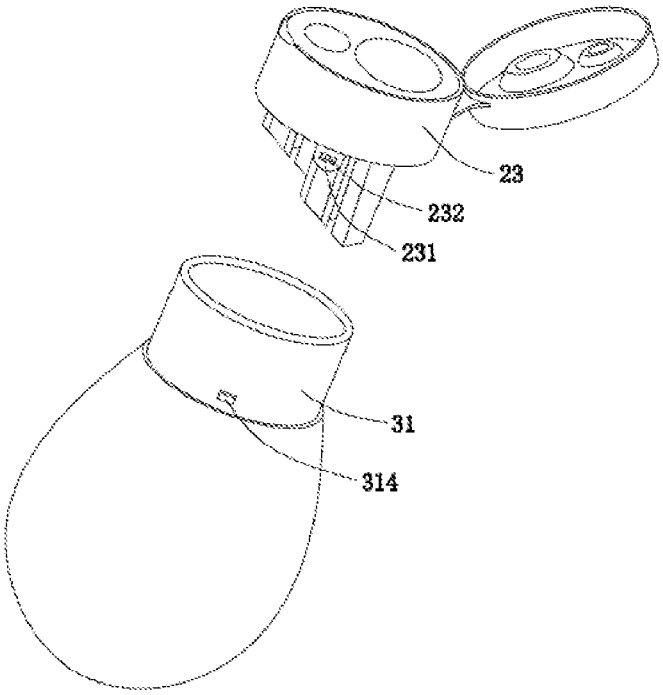
FIG. 9 is a partial exploded view of seventh embodiment of the pencil sharpener having flexible storage cover of the present invention.

Referring to FIG. 9, in the seventh embodiment, at least one bendable folding piece 231 is disposed on the lower edge of the circumference of the base portion 23, a hole 232 is defined in the folding piece 231, a protrusion 314 is disposed at the fixing portion 31 corresponding to the hole. When the base portion is assembled to the fixing portion 31, the folding piece 231 is bent to buckle the protrusion 314 into the hole 232 of the folding piece 231, so that the main body portion and the receiving portion are fixed. The folding piece is pulled away from the protrusion, so that the folding piece is separated from the protrusion to separate the main body portion from the flexible storage portion, when disassembly. In the embodiment, the number of the folding pieces and the number of the protrusions are both two.

The above is only the preferred embodiment of the present invention. It should be pointed out that for ordinary technicians in the technical field, without departing from the principles of the present invention, a number of improvements and finishing can also be made, and these improvements and finishing should also be considered as the scope of protection of the present invention.

What is claimed is:

1. A pencil sharpener having a flexible storage cover, comprising: a main body portion having a base including a base portion and a blade received in the base for sharpening pencils, an insertion hole being defined in the blade for inserting the pencils, and at least one hole being defined in a top of the base portion corresponding to the insertion hole of the blade; wherein, the pencil sharpener further comprises a flexible storage portion for receiving pencil shavings, the flexible storage portion is detachably assembled with the base portion of the base, wherein the flexible storage portion comprises a fixing portion and a flexible storage cover assembled on the fixing portion, and the fixing portion is matched with the base portion of the base.

2. The pencil sharpener having a flexible storage cover as claimed in claim 1, wherein a layer of hot melting material is disposed on a hood opening portion of the flexible storage cover, and the flexible storage cover and the fixing portion are fixed together by hot melting technology.

3. The pencil sharpener having a flexible storage cover as claimed in claim 1, wherein the flexible storage cover and the fixing portion are fixed together by sewing the flexible storage cover.

4. The pencil sharpener having a flexible storage cover as claimed in claim 1, wherein the fixing portion comprises a first fixing portion and a second fixing portion, an inner diameter of the first fixing portion is slightly larger than that of the second fixing portion, the second fixing portion is wrapped in the hood opening portion of the flexible storage cover, and the first fixing portion clamps and fixes the hood opening portion of the flexible storage cover to an outer portion of the second fixing portion so that the fixing portion and the flexible storage cover can be fixed together.

5. The pencil sharpener having a flexible storage cover as claimed in claim 1, wherein an internal thread is disposed on the base portion of base, an external thread capable of being in threaded connection with the internal thread of base portion of base is disposed on outer circumference of the fixing portion, the base and the fixing portion are in threaded connection to assemble or disassemble the base and the flexible storage cover.

6. The pencil sharpener having a flexible storage cover as claimed in claim 1, wherein the base portion of the base and the flexible storage portion are respectively provided with buckle structures so as to fix the base and the flexible storage portion.

7. The pencil sharpener having a flexible storage cover as claimed in claim 6, wherein a protruding rib is disposed on inner side of the base portion of the base, a groove is defined in the flexible storage portion corresponding to the protruding rib, and the base and the flexible storage portion are fixed together by cooperation of the protruding rib and the groove.

8. The pencil sharpener having a flexible storage cover as claimed in claim 6, wherein protruding ribs are disposed on inner side of the base portion of the base, grooves are defined in the flexible storage portion corresponding to the protruding ribs, the base and the flexible storage portion are fixed together by cooperation of the protruding ribs and the grooves.

9. The pencil sharpener having a flexible storage cover as claimed in claim 6, wherein at least one bendable folding piece is disposed on the lower edge of the circumference of the base portion, a hole is defined in the folding piece, a protrusion is disposed on the fixing portion corresponding to the hole, when the base portion is assembled to the fixing portion, the folding piece is bent to buckle the protrusion into the hole of the folding piece, so that the main body portion and the flexible storage portion are fixed together, when the base portion is disassembled from the fixing portion, the folding piece is pulled away from the protrusion, so that the folding piece is separated from the protrusion to separate the main body portion from the flexible storage portion.

10. The pencil sharpener having a flexible storage cover as claimed in claim 1, wherein the base comprises a dustproof cover corresponding to the base portion, the dustproof cover and base portion are connected together by a foldable part, the dustproof cover can be opened from base portion when in use, and the dustproof cover also can be covered and buckled and fixed on the base portion after use.

11. The pencil sharpener having a flexible storage cover as claimed in claim 10, wherein protrusions are disposed on the dustproof cover corresponding to the holes in size and shape of the base portion, when the dustproof cover covers on the base portion, the protrusions protrude and buckle into the holes in the top portion of the base portion so as to fix the dustproof cover on the base portion.

* * * * *